US008724978B2

(12) United States Patent
Furumura et al.

(10) Patent No.: US 8,724,978 B2
(45) Date of Patent: May 13, 2014

(54) FLUID HEATING-COOLING CYLINDER DEVICE

(75) Inventors: Yuji Furumura, Kanagawa (JP); Naomi Mura, Tokyo (JP); Shinji Nishihara, Tokyo (JP); Noriyoshi Shimizu, Tokyo (JP)

(73) Assignee: Philtech, Inc., Tokyo (JP)

( * ) Notice: Subject to any disclaimer, the term of this patent is extended or adjusted under 35 U.S.C. 154(b) by 0 days.

(21) Appl. No.: 13/616,517

(22) Filed: Sep. 14, 2012

(65) Prior Publication Data

US 2013/0302021 A1 Nov. 14, 2013

(30) Foreign Application Priority Data

May 8, 2012 (JP) ..... 2012-107128

(51) Int. Cl.
*F24H 1/10* (2006.01)

(52) U.S. Cl.
USPC ..... 392/491; 392/484; 392/487

(58) Field of Classification Search
None
See application file for complete search history.

(56) References Cited

U.S. PATENT DOCUMENTS

| | | | | | |
|---|---|---|---|---|---|
| 3,584,194 | A | * | 6/1971 | Kautz et al. | 392/484 |
| 3,835,294 | A | * | 9/1974 | Krohn et al. | 392/484 |
| 3,854,032 | A | * | 12/1974 | Cooper | 219/383 |
| 3,901,447 | A | * | 8/1975 | Gross | 239/139 |
| 4,480,172 | A | * | 10/1984 | Ciciliot et al. | 392/396 |
| 4,975,559 | A | * | 12/1990 | Frisch | 392/449 |
| 6,053,435 | A | * | 4/2000 | Hung | 239/590 |
| 7,286,752 | B2 | * | 10/2007 | Gourand | 392/479 |
| 7,471,882 | B2 | * | 12/2008 | Peebles et al. | 392/311 |
| 7,756,404 | B2 | * | 7/2010 | Schubert et al. | 392/478 |
| 7,823,543 | B2 | | 11/2010 | Nomura | |

FOREIGN PATENT DOCUMENTS

| | | |
|---|---|---|
| JP | 2011001591 | 1/2011 |
| WO | 2006030526 | 3/2006 |

* cited by examiner

*Primary Examiner* — Thor Campbell
(74) *Attorney, Agent, or Firm* — BainwoodHuang

(57) ABSTRACT

Provided is a fluid heating device that is small in size and capable of heating a large flow of gas or liquid at a low cost. A flow path in which no backwater is produced is provided by providing grooved flow paths of a fluid are provided over an outer side surface of a metallic circular cylinder such that a fluid passing through a narrowed one of the flow paths impinges perpendicularly against a wall of the next flow path. This allows instantaneous heat exchange within a small space, and makes manufacturing of such a structure simple.

20 Claims, 3 Drawing Sheets

PRIOR ART

FLUID HEATING-COOLING CYLINDER DEVICE

This application is based on and claims the benefit of propriety from Japanese Patent Application No. 2012-107128, filed on May 8, 2012, the content and teachings of which are incorporated by reference herein their entirety.

BACKGROUND OF THE INVENTION

1. Field of the Invention

The present invention relates to a cylindrically shaped device capable of instantaneously heating a fluid, in particular, a gas.

2. Description of the Related Art

There is known a device for heating a gas. Typically, this device heats a gas by letting the gas to pass through a heated pipe. Alternatively, this device heats a gas by causing a heated fluid to flow through a pipe having fins and letting the gas to pass between the fins.

A device for cooling a gas, opposite of heating, is configured in the same manner.

Conventional examples of such a device are illustrated in FIG. 1 and FIG. 2.

FIG. 1 is a copy of a drawing schematically illustrating an exemplary patent that realizes a heating mechanism called an impinging jet (WO 2006/030526). A gas that has passed a pipe impinges against a heated circular disk and exchanges heat.

FIG. 2 is a copy of a drawing illustrating a patent for a plate-shaped device for producing a heated gas (FIG. 5 of Japanese Patent Application No. 2009-144807, "Gas Heating Apparatus").

Applications of a device for instantaneously heating a gas and ejecting a hot gas include steps of heating and firing various materials (such as a metal and a dielectric material) applied on a substrate, in addition to air heating and drying.

The present invention relates to a device for instantaneously heating a gas and ejecting a hot gas.

Accordingly, an object of the present invention is to downsize a device for heating a gas as much as possible. Another object of the present invention is to provide a simplified manufacturing method.

Yet another object of the present invention is to realize a range of heating temperatures from room temperature to 1000 degrees Celsius or above. By simplifying the processing, it is possible to reduce a manufacturing cost. The reduced cost allows the gas heating device to be applicable to a wide range of industries.

SUMMARY OF THE INVENTION

For purposes of summarizing the invention, certain aspects of the invention have been described herein. It is to be expressly understood that it is not intended as a definition of the limits of the invention.

In order to solve the aforementioned problems, the present invention proposes the following arrangements.

A first aspect of the present invention provides a fluid heating device provided with: an inner cylinder having a plurality of annular grooves provided around an outer side surface of the inner cylinder and a plurality of sets of connecting grooves provided on the outer side surface, each set of connecting grooves connecting two of the annular grooves, circumferential positions of connecting grooves in two of the sets of connecting grooves provided on respective sides of one of the annular grooves are displaced from each other; and a cylinder containing the inner cylinder in close contact with each other, wherein a fluid flows through a flow path defined by an inner wall of the cylinder and the outer side surface of the inner cylinder, and whereby heat is exchanged between the fluid and the flow path.

A second aspect of the present invention provides a heating device provided with: an inner cylinder having a plurality of annular grooves provided around an outer side surface of the inner cylinder and a plurality of sets of connecting grooves provided on the outer side surface, each set of connecting grooves connecting two of the annular grooves, circumferential positions of connecting grooves in two of the sets of connecting grooves provided on respective sides of one of the annular grooves are displaced from each other; and a cylinder containing the inner cylinder in close contact with each other, wherein one of a gas and a liquid flows through a flow path defined by an inner wall of the cylinder and the outer side surface of the inner cylinder, and whereby heat is exchanged between the one of the gas and the liquid and the flow path.

A third aspect of the present invention provides the heating device according to the second aspect, wherein the gas is one of an inert gas, a reductive gas, a gas containing a Group 6 element, a gas containing a Group 7 element, and a combination of two or more of these gases, examples of the inert gas including nitrogen, argon, helium, carbon hydride, and carbon fluoride, the reductive gas being one of hydrogen and a gas releasing hydrogen, examples of the gas containing a Group 6 element including oxygen, sulfur, selenium, and tellurium, examples of the gas containing a Group 7 element including fluorine.

A fourth aspect of the present invention provides the heating device according to the second aspect, wherein the gas contains one of water and air.

A fifth aspect of the present invention provides the heating device according to the second aspect, wherein the liquid is one of water and a liquid containing water.

A sixth aspect of the present invention provides the heating device according to the first aspect, wherein each of the cylinder and the inner cylinder is configured by one of a metal and a metal coated by a different kind of metal.

A seventh aspect of the present invention provides the heating device according to the first aspect, wherein each of the cylinder and the inner cylinder is configured by ceramic, examples of a material of the ceramic including quartz, alumina, and silicon carbide.

An eighth aspect of the present invention provides the heating device according to the first aspect, wherein each of the cylinder and the inner cylinder is configured by one of a metal and a metal coated by a different kind of metal, and a heater inserted into the inner cylinder heats one of a circular column and the cylinder.

A ninth aspect of the present invention provides the heating device according to the first aspect, wherein each of the cylinder and the inner cylinder is configured by ceramic, examples of a material of the ceramic including quartz, alumina, and silicon carbide, and a heater inserted into the inner cylinder heats one of a circular column and the cylinder.

A tenth aspect of the present invention provides the heating device according to the first aspect, wherein the inner cylinder is configured as one of a circular cylinder and a polygonal cylinder including a rectangular cylinder.

An eleventh aspect of the present invention provides the heating device according to the first aspect, wherein each of the cylinder and the inner cylinder is configured by one of a metal and a metal coated by a different kind of metal, and the inner cylinder is configured as one of a circular cylinder and a polygonal cylinder including a rectangular cylinder.

A twelfth aspect of the present invention provides the heating device according to the first aspect, wherein each of the cylinder and the inner cylinder is configured by ceramic, examples of a material of the ceramic including quartz, alumina, and silicon carbide, and the inner cylinder is configured as one of a circular cylinder and a polygonal cylinder including a rectangular cylinder.

According to the first aspect of the present invention, it is possible to perform heat exchange between the inner cylinder contained within the heated cylinder of a simple structure and the fluid. Processing for this structure is only required to a surface of the inner cylinder.

When the fluid flows through the connecting grooves that are made to be narrow, a velocity of the fluid increases. This high-speed fluid impinges furiously against the wall of the annular groove, and heat is exchanged instantaneously with the heated inner cylinder.

As the circumferential positions of the connecting grooves on either side of an annular groove are not the same, the fluid that has exited from the connecting groove does not form a laminar flow. Formation of a laminar flow results in a stagnant backwater between the groove and the fluid and provides a resistance of the heat transfer, and whereby instantaneous heat exchange is prevented.

The cylinder and the inner cylinder having the processed grooves allows the processed grooves to constitute the flow path only by containing the inner cylinder that have been accurately processed within the cylinder in close contact with each other, and therefore such a structure can be easily manufactured with a reduced number of steps.

According to the second to the fifth aspect of the present invention, a gas or a liquid can be used as the fluid. As the gas, any gas can be freely selected. When oxygen and such are selected, it is possible to instantaneously produce heated oxygen. When hydrogen is selected, it is possible to instantaneously produce a strong hot reductive gas. By spraying the hot gas to a base material, it is possible to perform a surface treatment of the base material by a heated gas without heating the base material itself. Alternatively, when using a carbon dioxide gas, it is possible to provide a carbon dioxide film (a graphene or carbon nanotube film).

When using water as the fluid, it is possible to instantaneously produce a high-temperature steam. This heating device can be manufactured small in size, and therefore it is possible to spray the steam while bringing the heating device is closer to a base material to be sprayed.

As the heated high-temperature steam is effective for cleaning a base material without using chemicals, this heating device is applicable as a component of a cleaning device.

According to the sixth and the seventh aspect of the present invention, this heating device can be made of either a metal or ceramic. Manufacturing the inner cylinder and the cylinder of a metal and welding a connecting section therebetween allow a hermetic structure, and therefore it is possible to manufacture a heating device shielded from an external environment.

When using a material that does not become oxidized such as ceramic, it is possible to instantaneously heat an oxidized gas or a corrosive fluid. In addition, it is possible to use this heating device in the application in which avoidance of metal contamination is required.

According to the eighth to the twelfth aspect of the present invention, it is possible to perform the heating only by providing a hole along a central axis of the inner cylinder and inserting a heater in this hole. This configuration is simple and provides simple maintenance when only one heater is used. The heating device as a whole can be manufactured in a circularly or polygonally cylindrical shape, and with this, it is possible to produce a heated gas beam in a shape of circular or quadrangular ring. By narrowing the outlet of the cylinder to form a single tube, it is possible to produce a single heated beam in a shape of beam. Further, when the inner cylinder is formed in a shape such as triangular, quadrangular, hexagonal, or octagonal, it is possible to combine more than one inner cylinder without any gap.

DETAILED DESCRIPTION OF THE INVENTION

Description will be made below regarding embodiments of the present invention with reference to the drawings. It should be noted that each of the components of the following embodiments can be replaced by a different known component or the like as appropriate. Also, any kind of variation may be made including a combination with other known components. That is to say, the following embodiments described below do not intend to limit the content of the present invention described in the appended claims.

Figure 1:
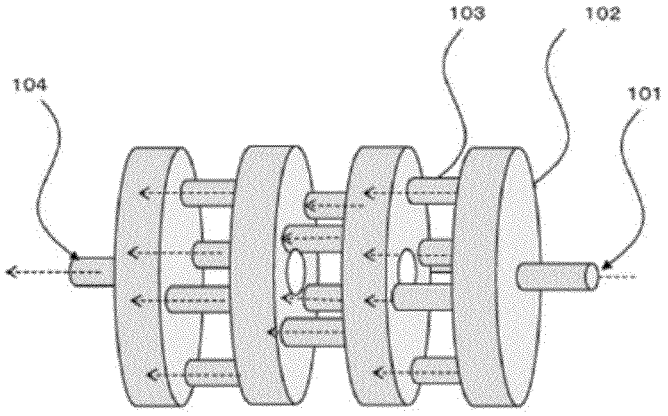
FIG. 1 is a schematic view of one example of a conventional gas heating device (WO 2006/030526)
Figure 2:
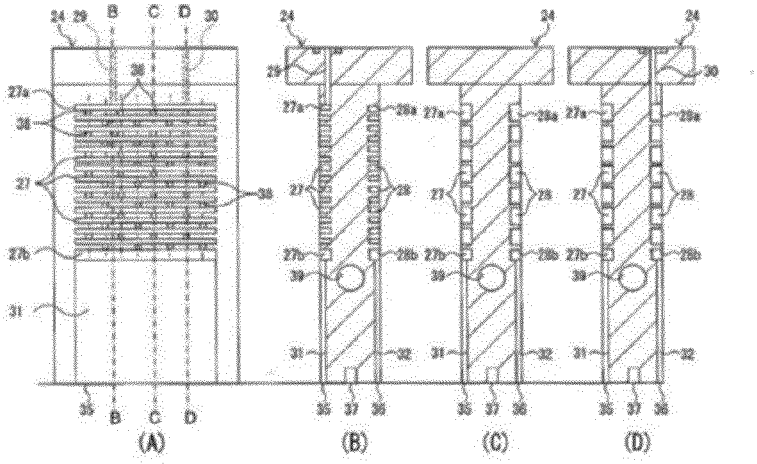
PRIOR ART FIG. 2
FIG. 2 is a schematic view of another example of the conventional gas heating device (FIG. 5 of Japanese Patent Application No. 2009-144807, "Gas Heating Apparatus")
Figure 3:
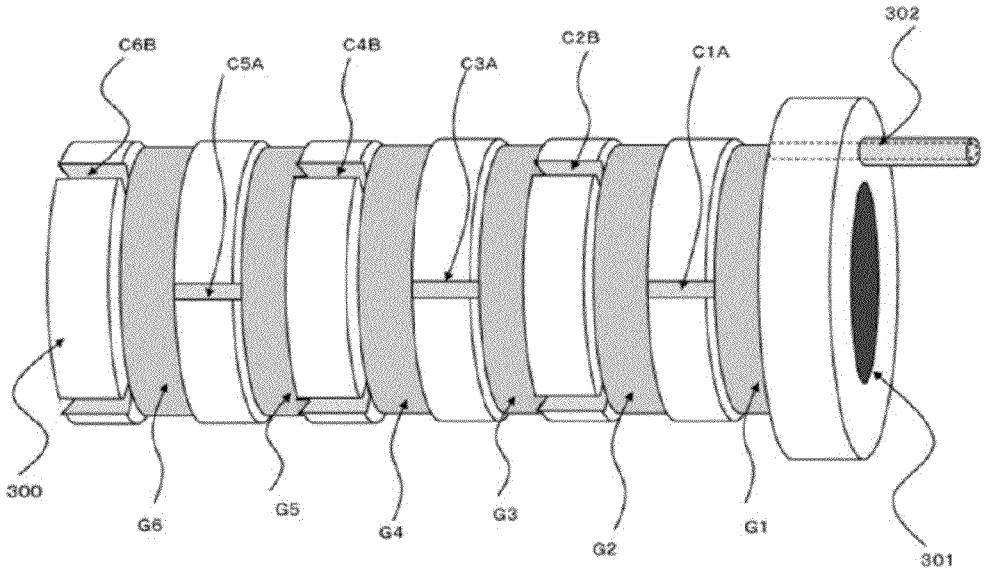
FIG. 3 is a schematic view of an inner cylinder unit.

FIG. 3 shows a schematic cubic diagram of an inner cylinder unit 300. In a center of the inner cylinder unit 300, a heater hole 301 for containing a heater is provided.

The inner cylinder unit 300 is made of SUS310S stainless steel. A circular cylinder is processed such that six annular grooves G1, G2, G3, G4, G5, and G6 are provided therearound. A depth and a width of these annular grooves are 3 mm and 5 mm, respectively. Then, four connecting grooves C1A connecting the annular grooves G1 and G2 are provided. In the reference symbol C1A, "1" indicates that these connecting grooves are connected to the annular groove G1, and "A" represents a phase specifying circumferential positions of these connecting grooves.

A depth and a width of these connecting grooves C1A are 3 mm and 1 mm, respectively.

In the same manner, four connecting grooves C2B connecting the annular grooves G2 and G3 are provided. In the reference symbol C2B, "2" indicates that these connecting grooves are connected to the annular groove G2, and "B" represents a phase specifying circumferential positions of these connecting grooves.

The phase B corresponds to a midpoint of the phase A along the circumference. The relation between the phases can be freely designed. In this case, as there are four connecting grooves along the circumference, the phase A and the phase B are displaced from each other by 45 degrees. If the number of connecting grooves provided along the circumference is six, the displacement is 30 degrees.

In the same manner, connecting grooves C3A, C4B, C5A, and C6B are provided.

A fluid inlet tube 302 is welded, and a fluid introduced into this inlet tube is directed to the annular groove G1.

The inner cylinder unit 300 provided with the heater hole 301, the annular grooves G1-G6, and the connecting grooves C1A, C2B, C3A, C4B, C5A, and C6B is contained within a cylinder.

Figure 4:
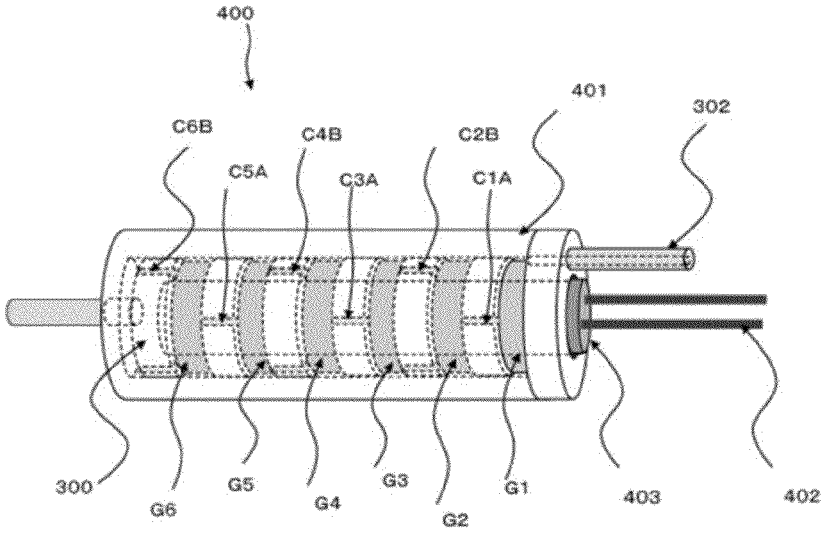
FIG. 4 is a perspective view of a fluid heating mechanism in which the inner cylinder unit and a cylinder unit for containing the inner cylinder unit are incorporated.

FIG. 4 is a perspective view of a fluid heating mechanism 400 in which the inner cylinder unit 300 and a cylinder unit for containing the inner cylinder unit 300 are incorporated.

The inner cylinder unit 300 is in close contact with an inner wall of the cylinder unit 401. A connected section therebetween is welded so as to prevent a fluid from leaking.

A fluid pressurized and introduced through the fluid inlet tube 302 passes through the annular grooves, and becomes a high-speed fluid when passing through the connecting grooves. The high-speed fluid impinges against a wall of the annular groove perpendicularly at a high speed. By impinging perpendicularly, a stagnant backwater as a resistance of heat transfer may not be produced.

The inner cylinder unit 300 is heated by a heater 403 that is fed from a heater power feeder 402. The heater is made of silicon carbide, and capable of heating at 1000 degrees Celsius.

The cylinder unit 401 and the inner cylinder unit 300 are made of SUS310S, and therefore can be heated up to 1000 degrees Celsius.

Figure 5:
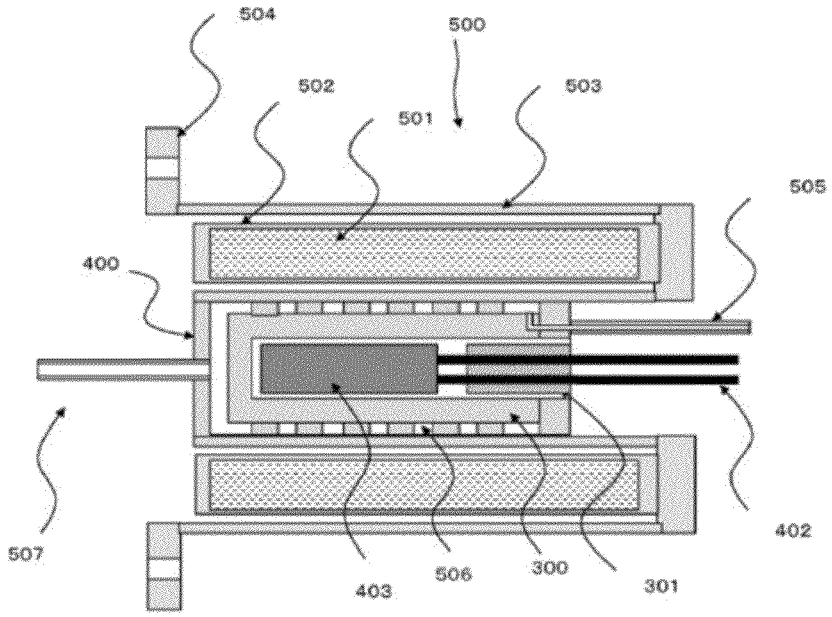
FIG. 5 is a schematic cross-sectional view of a fluid heating device representing an entire case containing the fluid heating mechanism.

FIG. 5 is a schematic cross-sectional view of a fluid heating device representing an entire case containing the fluid heating mechanism 400.

A fluid heating device 500 is configured by containing the fluid heating mechanism 400 within an insulator case. The fluid heating mechanism 400 is insulated by an insulator case 502 containing an insulator 501.

Outside the insulator case 502, a stainless-steel external case 503 is provided, and an end of the external case 503 is connected to a flange 504.

The inner cylinder unit is heated by the heater 403 that is fed from the heater power feeder 402. The temperature of the inner cylinder unit is measured by a thermocouple that is not depicted, and the electric power is controlled so as to maintain the measured temperature. Here, in order to produce heated nitrogen at 500 degrees Celsius, the electric power is fed so as to be able to maintain the temperature at 500 degrees Celsius.

A nitrogen gas of 100 SLM is supplied through a gas inlet tube 505. The nitrogen gas flows through an annular groove 506 and the connecting grooves that are not visible in this figure, and is instantaneously heated within the fluid heating mechanism 400.

The nitrogen heated up to 500 degrees Celsius exits through a gas outlet tube 507.

If the heating temperature is controlled at 300 degrees Celsius, it is possible to obtain nitrogen at 300 degrees Celsius.

In the above, an example in which a nitrogen gas is heated has been described. However, a gas other than the nitrogen gas can be freely used in this heating mechanism.

It is possible to use any of an inert gas examples of which including argon, helium, carbon hydride, and carbon fluoride, hydrogen and a reductive gas releasing hydrogen, a gas containing a Group 6 element examples of which including oxygen, sulfur, selenium, and tellurium, and a gas containing a Group 7 element examples of which including fluorine. Alternatively, it is possible to use a combination of two or more of these gases. In addition, when carbon hydride is used, carbon hydride is dissolved and a film such as a graphene film can be formed.

Further, the gas can contain one of water and air.

It is also possible to freely use a fluid other than the gas. For example, when water is used as the fluid, it is possible to produce a high-temperature steam.

In the above embodiment, the cylinder and the inner cylinder unit are made of SUS310S. However, it is possible to freely select a suitable material according to a temperature range to be used and characteristics of the fluid to be used. A material that constitutes the components can be a metal such as stainless and aluminum, as well as a metal coated by a different kind of metal.

Further, in an application in which avoidance of metal contamination is in particular required, the inner cylinder unit and the cylinder can be made of ceramic including such as quartz, alumina, and silicon carbide.

The present invention provides a downsized component capable of producing a large flow of hot gas or liquid, and can be used in application fields such as drying of printed materials, small-sized heating appliances, air heating in glass houses, and producing a high-temperature medical agent for cleaning. The present invention is also suitable for a technique of film formation of such as a solar cell or a flat-panel display device (FPD) on a large-sized substrate such as a glass substrate at a low cost. Further, it is possible to obtain a degradation film when a gas that can be pyrolyzed is used. Moreover, it is possible to obtain a carbon film from carbon hydride.

While preferred embodiments of the invention have been described and illustrated above, it should be noted that these are example embodiments of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

DESCRIPTION OF THE REFERENCE NUMERALS

101 Gas Inlet
102 Hollow Disk
103 Pipe
104 Gas Outlet
300 Inner Cylinder Unit
301 Heater Hole
302 Fluid Inlet Tube
C1A, C2B, C3A, C4B, C5A, C6B Connecting Grooves
G1, G2, G3, G4, G5, G6 Annular Grooves
400 Fluid Heating Mechanism
401 Cylinder Unit
402 Heater Power Feeder
403 Heater
500 Fluid Heating Device
501 Insulator
502 Insulator Case
503 External Case
504 Flange
505 Gas Inlet Tube
506 Annular Groove
507 Gas Outlet Tube

What is claimed is:

1. A fluid heating device, comprising:

an inner cylinder having a plurality of annular grooves provided around an outer side surface of the inner cylinder and a plurality of sets of connecting grooves provided on the outer side surface, each set of connecting grooves connecting two of the annular grooves, circumferential positions of connecting grooves in two of the sets of connecting grooves provided on respective sides of one of the annular grooves are displaced from each other; and a cylinder containing the inner cylinder in close contact with each other, wherein one of a gas and a liquid flows through a flow path defined by an inner wall of the cylinder and the outer side surface of the inner cylinder, and whereby heat is exchanged between the one of the gas and the liquid and the flow path;

wherein the inner cylinder defines a central axis; and wherein the inner cylinder further has (i) an inlet side at one end of the central axis, (ii) an outlet side at another end of the central axis, and (iii) a heater cavity which extends along the central axis to a heater opening to receive a heater, the heater opening being disposed on the inlet side of the inner cylinder and being coaxial with the central axis.

2. The heating device according to claim 1, wherein the gas is one of an inert gas, a reductive gas, a gas containing a Group 6 element, a gas containing a Group 7 element, and a combination of two or more of these gases, examples of the inert gas including nitrogen, argon, helium, carbon hydride, and carbon fluoride, the reductive gas being one of hydrogen and a gas releasing hydrogen, examples of the gas containing a Group 6 element including oxygen, sulfur, selenium, and tellurium, examples of the gas containing a Group 7 element including fluorine.

3. The heating device according to claim 1, wherein the gas contains one of water and air.

4. The heating device according to claim 1, wherein the liquid is one of water and a liquid containing water.

5. A fluid heating device, comprising:

an inner cylinder having a plurality of annular grooves provided around an outer side surface of the inner cylinder and a plurality of sets of connecting grooves provided on the outer side surface, each set of connecting grooves connecting two of the annular grooves, circumferential positions of connecting grooves in two of the sets of connecting grooves provided on respective sides of one of the annular grooves are displaced from each other; and a cylinder containing the inner cylinder in close contact with each other, wherein a fluid flows through a flow path defined by an inner wall of the cylinder and the outer side surface of the inner cylinder, and whereby heat is exchanged between the fluid and the flow path; and wherein the inner cylinder defines (i) an inlet end, (ii) an outlet end, (iii) a central axis which extends between the inlet end and the outlet end, and (iv) a heater cavity which extends along the central axis to a heater opening at the inlet end to receive a heater, the heater opening defined by the inner cylinder being coaxial with the central axis.

6. The heating device according to claim 5, wherein each of the cylinder and the inner cylinder is configured by one of a metal and a metal coated by a different kind of metal.

7. The heating device according to claim 5, wherein each of the cylinder and the inner cylinder is configured by ceramic, examples of a material of the ceramic including quartz, alumina, and silicon carbide.

8. The heating device according to claim 5, wherein each of the cylinder and the inner cylinder is configured by one of a metal and a metal coated by a different kind of metal, and a heater inserted into the inner cylinder heats one of a circular column and the cylinder.

9. The heating device according to claim 5, wherein each of the cylinder and the inner cylinder is configured by ceramic, examples of a material of the ceramic including quartz, alumina, and silicon carbide, and a heater inserted into the inner cylinder heats one of a circular column and the cylinder.

10. The heating device according to claim 5, wherein the inner cylinder is configured as one of a circular cylinder and a polygonal cylinder including a rectangular cylinder.

11. The heating device according to claim 5, wherein each of the cylinder and the inner cylinder is configured by one of a metal and a metal coated by a different kind of metal, and the inner cylinder is configured as one of a circular cylinder and a polygonal cylinder including a rectangular cylinder.

12. The heating device according to claim 5, wherein each of the cylinder and the inner cylinder is configured by ceramic, examples of a material of the ceramic including quartz, alumina, and silicon carbide, and the inner cylinder is configured as one of a circular cylinder and a polygonal cylinder including a rectangular cylinder.

13. The heating device according to claim 5, further comprising:

an inlet tube to convey the fluid into the flow path, the inlet tube connecting to the inner cylinder at the inlet end, and an outlet tube to allow the fluid to exit the flow path, the outlet tube connecting to the inner cylinder at the outlet end.

14. The heating device according to claim 13, wherein the inlet tube extends along an axis which is parallel and non-coaxial with the central axis defined by the inner cylinder.

15. The heating device according to claim 14, further comprising:

a heater which installs within the heater cavity in a direction along the central axis through the heater opening defined by the inner cylinder.

16. The heating device according to claim 15, wherein the heater is constructed and arranged to provide a heating temperature of at least 1000 degrees Celsius.

17. The heating device according to claim 14, wherein the outlet tube extends from the inner cylinder in a direction which is coaxial with the central axis defined by the inner cylinder.

18. The heating device according to claim 17, wherein the annular grooves have an annular groove width;

wherein the connecting grooves have a connecting groove width; and wherein the annular groove width is more than twice as wide as the connecting groove width.

19. The heating device according to claim 18, wherein the annular groove width is 5 millimeters in size, and wherein the connecting groove width is 1 millimeter in size.

20. The heating device according to claim 19, wherein the cylinder is welded to the inner cylinder to permanently contain the inner cylinder; and wherein the cylinder which permanently contains the inner cylinder has a downsized form factor to eject, as the fluid, a large flow of hot gas.

* * * * *